US007437829B2

(12) United States Patent
Pryor

(10) Patent No.: US 7,437,829 B2
(45) Date of Patent: Oct. 21, 2008

(54) CROSS TIE CONNECTION BRACKET

(76) Inventor: John Duncan Pryor, 4028 39th Ave., Oakland, CA (US) 94619

( * ) Notice: Subject to any disclaimer, the term of this patent is extended or adjusted under 35 U.S.C. 154(b) by 0 days.

(21) Appl. No.: 11/542,893

(22) Filed: Oct. 3, 2006

(65) Prior Publication Data

US 2007/0022704 A1 Feb. 1, 2007

Related U.S. Application Data

(62) Division of application No. 10/690,925, filed on Oct. 21, 2003, now Pat. No. 7,117,648.

(51) Int. Cl.
*B43L 13/00* (2006.01)

(52) U.S. Cl. ..... 33/638; 33/645

(58) Field of Classification Search ..... 52/127.5, 52/698, 699, 700, 749.1; 29/464, 466, 281.5; 33/533, 645, 638
See application file for complete search history.

(56) References Cited

U.S. PATENT DOCUMENTS

| | | | | |
|---|---|---|---|---|
| 1,054,175 | A | 2/1913 | Coffin | |
| 1,474,660 | A | 11/1923 | White | |
| 2,890,607 | A * | 6/1959 | McLane | 408/72 R |
| 3,053,121 | A * | 9/1962 | Proctor | 408/108 |
| 3,264,021 | A | 8/1966 | Artman | |
| 3,340,913 | A * | 9/1967 | Gustafson | 29/281.1 |
| 3,837,754 | A | 9/1974 | Malcik | |
| 3,973,860 | A * | 8/1976 | Kern | 408/108 |
| 4,129,975 | A | 12/1978 | Gabriel | |
| 4,173,857 | A | 11/1979 | Kosaka | |
| 4,192,118 | A | 3/1980 | Gilb | |
| 4,271,654 | A | 6/1981 | Jungbluth | |
| 4,321,776 | A | 3/1982 | Delight | |
| 4,611,948 | A | 9/1986 | Johnson | |
| 4,616,950 | A | 10/1986 | Morris | |
| 4,701,065 | A | 10/1987 | Orosa | |
| 4,744,192 | A | 5/1988 | Commins | |
| 4,825,621 | A | 5/1989 | Jensen | |
| 4,893,961 | A | 1/1990 | O'Sullivan et al. | |
| 5,092,096 | A | 3/1992 | Cornell | |

(Continued)

OTHER PUBLICATIONS

Zone Four "Innovative Engineered Solutions," published 2000, pp. 1-23.

(Continued)

*Primary Examiner*—Richard E. Chilcot, Jr.
*Assistant Examiner*—Jessica Laux
(74) *Attorney, Agent, or Firm*—IPx Law Group LLP; Claude A.S. Hamrick

(57) ABSTRACT

A cross tie bracket that is attachable to a rod and a building structural element. The cross tie bracket has a generally cylindrical body sized to receive the rod and a gusset disposed between the body and a base. The base has a series of apertures formed therein for inserting fasteners through the base into the building structural element, temporarily securing the cross tie bracket to the building structural element with screws, and for providing alignment of a temporary drill guide with the base. A first and second end plate are disposed adjacent to each respective end of the cylindrical body. Each of the end plates has a rod aperture sized to receive the rod. Accordingly, by inserting and securing the rod to the end plates, it is possible to attach the rod to the building structural element.

17 Claims, 13 Drawing Sheets

U.S. PATENT DOCUMENTS 5,092,097 A 3/1992 Young
5,145,132 A 9/1992 Kirschner
5,228,261 A 7/1993 Watkins
5,249,404 A 10/1993 Leek et al.
5,367,852 A 11/1994 Masuda et al.
5,467,570 A 11/1995 Leek
5,491,935 A 2/1996 Coxum
5,561,956 A 10/1996 Englekirk et al.
5,575,129 A 11/1996 Goto
5,678,375 A * 10/1997 Juola ..... 52/655.1
5,809,719 A 9/1998 Ashton et al.
5,813,181 A 9/1998 Ashton et al.
5,876,003 A 3/1999 Waagenaar
5,881,514 A 3/1999 Pryor
5,921,042 A 7/1999 Ashton et al.
5,992,126 A 11/1999 Ashton et al.
6,006,487 A 12/1999 Leek
6,112,486 A 9/2000 Ashton et al.
6,327,831 B1 12/2001 Leek
6,389,767 B1 5/2002 Lucey et al.
6,425,220 B1 * 7/2002 Ashton et al. ..... 52/291
6,453,634 B1 9/2002 Pryor
6,782,668 B2 8/2004 Bruce

OTHER PUBLICATIONS

Simpson Strong-Tie Co., Inc., "Wood Construction Connectors," Catalog C-2003, published 2003, pp. 19-22 and 27-32.

* cited by examiner

CROSS TIE CONNECTION BRACKET

CROSS REFERENCE TO RELATED APPLICATION

This application is a Divisional Application of U.S. application Ser. No. 10/690,925, filed Oct. 21, 2003, now U.S. Pat. No. 7,117,648, the entire contents of which is incorporated herein by reference and is relied upon for priority.

FIELD OF THE INVENTION

The present invention generally relates to devices used to interconnect and transfer forces between structural elements such as the walls of a building and its roof, floor, or other structural framing elements, or between the various roof, floor, and other structural framing elements themselves, and more particularly, to an improved bracket for connecting adjacent structural elements together with a rod for the transfer of both tension and compression forces, particularly with regard to the installation of wall ties, continuity ties, and collector ties in new or existing "tilt-up" and concrete block buildings, and the like.

BACKGROUND OF THE INVENTION

Tilt-up buildings generally consist of those types of structures that are constructed with concrete wall panels that are precast horizontally on the ground, cured, and then tilted up into place.

The roof framing systems of older tilt-up and concrete block buildings that were built between the early 1950's (when the initial construction of tilt-up buildings began) and the mid 1960's were generally constructed with long-span timber roof trusses and timber roof joists. The timber trusses in these buildings were typically oriented to span the short direction of the building. Spacing between these trusses generally varies between 16 and 24 feet. The roof joists generally consist of 2×8's, 2×10's, 2×12's, or 2×14's spaced at 24" o.c., and span between the timber trusses. At the perimeter of the building the roof joists span between the timber trusses and the tilt-up wall panels or concrete block walls, were they are typically framed onto a timber ledger that is bolted to the wall panel. Roof sheathing for these buildings typically consists of ⅜" of ½" plywood.

After the mid 1960's the roof framing systems of most tilt-up and concrete block buildings were generally constructed with glulam beams instead of long-span timber trusses and a "panelized" roof framing system instead of roof joists. These modifications to the roof framing systems of tilt-up and concrete block buildings were typically made for economic reasons.

A "panelized" roof framing system consists of timber purlins, timber sub-purlins (also known as stiffeners), and roof sheathing. The roof sheathing typically consists of 4'×8' sheets of ⅜" or ½" thick plywood, and spans between the sub-purlins. These sub-purlins are generally 2×4's or 2×6's, and span between the purlins. The purlins typically consist of 4×12's or 4×14's and span between the glulam beams (or in some cases longspan timber trusses). The plywood sheathing is typically oriented with it's long dimension parallel to the sub-purlins, or perpendicular to the purlins. The sub-purlins are generally spaced 24" apart. The purlins are typically spaced 8 feet apart to accommodate the length of the plywood sheathing. The glulam beams are typically spaced 20 to 24 feet apart. Sections of the panelized roof are typically fabricated on the ground and raised into place with a crane or forklift.

In areas subject to high seismicity, the connection between the concrete wall panels of most older tilt-up and concrete block buildings and their roof and floor framing systems is inadequate per the currently established seismic design standards for such buildings. Generally, this connection consists of only the nailing between the roof or floor sheathing and the timber ledger that is bolted to the wall panel or concrete block wall. This type of connection relies on a mechanism that subjects the ledgers to "cross grain bending", a mechanism that is highly vulnerable to failure. The deficiencies associated with this type of connection were responsible for numerous failures and collapses of tilt-up and concrete block buildings during the 1971 San Fernando Earthquake. As a result, this type of connection has been specifically disallowed since the 1973 Edition of the Uniform Building Code.

In the 1976 Edition of the Uniform Building Code, the provisions disallowing wall tie connections that rely on timber elements subjected to cross grain bending were supplemented to also prohibit the use of load transfer mechanisms that subject timber elements to "cross grain tension", a mechanism that is also highly vulnerable to failure. This provision effectively eliminated the use of plywood as a tension tie at the purlin and beam framing elements, and brought about the concept of sub-diaphragms and diaphragm continuity lines. This concept assumes that the forces associated with the wall tie system are transferred into a sub-diaphragm, a smaller portion of the overall roof (or floor) diaphragm that consists of the roof (or floor) framing elements and the associated plywood sheathing. The sub-diaphragm is intended to provide for the transfer of these loads to the diaphragm continuity lines, which extend across the buildings overall roof (or floor) diaphragm. The continuity lines are intended to transfer loads into the overall roof (or floor) diaphragm, which are then transferred to diaphragm collector elements and/or lateral load resisting elements, such as shear walls and/or steel frames. Diaphragm continuity lines are generally formed by interconnecting the major roof (or floor) framing elements together with continuity ties.

In general, most tilt-up and concrete block buildings are now constructed with discrete wall and diaphragm continuity ties. For existing tilt-up and concrete block buildings that were constructed without discrete wall and continuity ties, it is generally recommended that they be retrofitted with new connections per the currently established seismic design standards and/or recommendations for such buildings.

Wall and continuity tie installations typically consist of a connection bracket that is attached to either one or both sides of a roof (or floor) framing element, and attached to the wall in a wall tie installation, or another roof (or floor) framing element (with similar connection brackets attached) with a rod element in a continuity tie installation. At the present time the bolted connection devices that are most commonly used for wall and continuity tie applications are referred to as holdowns and continuity ties. An example of a holdown connection bracket is disclosed in U.S. Pat. No. 5,249,404. An example of a continuity tie connection bracket is disclosed in U.S. Pat. No. 5,813,181. The problems and deficiencies associated with the use of holdowns in wall and continuity tie applications are very significant, and are disclosed in U.S. Pat. No. 5,813,181.

Current continuity tie brackets generally consist of a rectangular box that defines the body element of the device. The body element is formed by bending a single piece of metal into the rectangular shape. End bearing plates are welded to both ends of the body element. A hole is provided in each end bearing plate, which allows for a rod element to extend through the body element of the continuity tie bracket. The rod hole can be located at the center of the end bearing plate, or offset in order to provide clearance between the rod and any potential interfering items associated with a wall or continuity tie installation, such as a metal support hanger at the end of a purlin in a panelized roof framing system. Nuts are used to secure the rod element to end bearing plates of the continuity tie bracket, allowing for the rod to transfer loads bi-directionally, in tension and compression. In order to secure the continuity tie bracket to the building structural member, a series of holes are provided through two of the opposing walls of the body element. This allows for installation of bolts that extend through these holes, and the body element, and into the roof (or floor) framing element of the building. The bolt holes in a continuity tie bracket are typically arranged in a staggered sequence on either side of the rod element in order to maximize the distance between the bolts.

A problem associated with the rectangular continuity tie bracket is that the bracket is heavy. The bracket is typically fabricated from steel in order to provide sufficient load capacity for the applications for which it is intended at reasonably economic costs. The sub-elements of the bracket are, generally fabricated from materials of constant thickness. The thickness of these sub-components is usually predicated on the load capacity required at one critical location, and thus may be unnecessarily thick at all other locations. The result of this situation is a rectangular continuity tie bracket that can be unnecessarily heavy and awkward to handle during installation. As will be recognized by those of ordinary skill in the art, the continuity tie brackets are typically installed in roof and floor framing systems where access is only obtainable with lifts or ladders. Fatigue of the installer is a concern when working on ladders. Therefore, the weight of the continuity tie bracket is a concern in order to reduce fatigue of the installer during the installation process.

Furthermore, it is difficult to consistently manufacture the rectangular continuity tie brackets. As previously mentioned above, the rod holes can be offset from the center of the end bearing plates and formed before the end bearing plate is welded to the body element. It is possible during the manufacturing process to install the end bearing plates incorrectly, such that the offset rod holes do not align and the rod cannot extend through the bracket.

Another drawback of the current continuity tie bracket is that in situations where brackets with offset rod holes are used in paired installations, with one bracket installed on each side of a structural framing element, a matched set of brackets must be used in order for the bolt holes in one bracket to align with the bolt holes of the other bracket. Specifically, the bolts used to attach the brackets to the beam must extend through both of the brackets. Therefore, the bolt holes must align between the two brackets in order to attach the brackets to the structural framing element.

The present invention addresses the above-mentioned deficiencies in the prior art continuity tie bracket by providing a geometry that facilitates ease of installation. Furthermore, the geometry of the bracket facilitates consistent manufacturing without errors. Additionally, the present invention can be configured so that there is no need for matched brackets for paired installations.

SUMMARY OF THE INVENTION

In accordance with an embodiment of the present invention, there is provided a cross tie bracket attachable to a rod and a building structural element. The cross tie bracket has a generally cylindrical body sized to receive and secure the rod. The inner diameter of the cylindrical body is sized slightly larger than the outer diameter of the rod such that the rod is insertable therein. Furthermore, the cross tie bracket has a base that is attached the body with a gusset. The gusset is disposed between the body and the base. The base has a series of fastening mounting apertures formed therein for inserting a fastener through the base and into the building structural element. In order to temporarily secure the bracket, a series of screw apertures are formed in the base for inserting temporary attachment screws through the base and into the building structural element. The base further includes a series of apertures formed therein to provide for the alignment of a temporary drill guide with the base. The gusset locates the body a prescribed distance away from the base. Respective first and second end plates are disposed adjacent to each end of the cylindrical body. Each of the end plates has a rod aperture formed therein that is sized to receive the rod. Accordingly, by inserting and attaching the rod to the cross tie bracket it is possible to join the rod to the building structural element.

In accordance with another embodiment of the present invention, there is provided a cross tie bracket that has a generally U-shaped body sized to receive and secure the rod. The U-shaped body is attached to a base. An end plate is attached to each respective end of the U-shaped body. Each end plate has a rod aperture formed therein for inserting the rod through the body.

In yet another embodiment of the present invention, there is provided a cross tie bracket having two generally planar body elements attached perpendicularly to a base. Each of the body elements is parallel to one another and form a channel through which the rod is insertable. Attached to the ends of the first and second body elements is a respective end plate. Each end plate has a rod aperture formed therein such that the rod is insertable through the aperture and into the channel formed by the first and second body elements.

In accordance with another embodiment of the present invention, there is provided a cross tie formed from two generally L-shaped body elements. Each of the body elements has a base portion and a bracket portion disposed generally perpendicular to the base portion. The bracket further includes two end plates wherein each end plate is attached to the same respective ends of the body elements. The body elements form a channel that is sized slightly larger than the diameter of the rod. Each end plate has a rod aperture formed therein for insertion of the rod through the end plates and the channel.

There is also provided a drill guide for aligning a drill bit with the fastener mounting apertures of a cross tie bracket. The drill guide has a generally planar alignment plate with a series of drill bit alignment apertures formed therein. Attached to the alignment plate is at least one drill guide alignment pin that is insertable into a drill guide alignment aperture of the cross tie bracket. An attachment bracket is attached to the alignment plate and is removably attachable to the cross tie bracket. The attachment bracket and the alignment pin linearly align the drill bit alignment apertures of the drill guide with the fastener mounting apertures of the cross tie bracket. A drill bit is insertable through the drill bit alignment apertures of the drill guide and the fastener mounting apertures of the cross tie bracket for drilling a hole into the building structural element.

BRIEF DESCRIPTION OF THE DRAWING FIGURES

These, as well as other features of the present invention, will become more apparent upon reference to the drawings wherein.

DETAILED DESCRIPTION OF THE INVENTION

Figure 1:
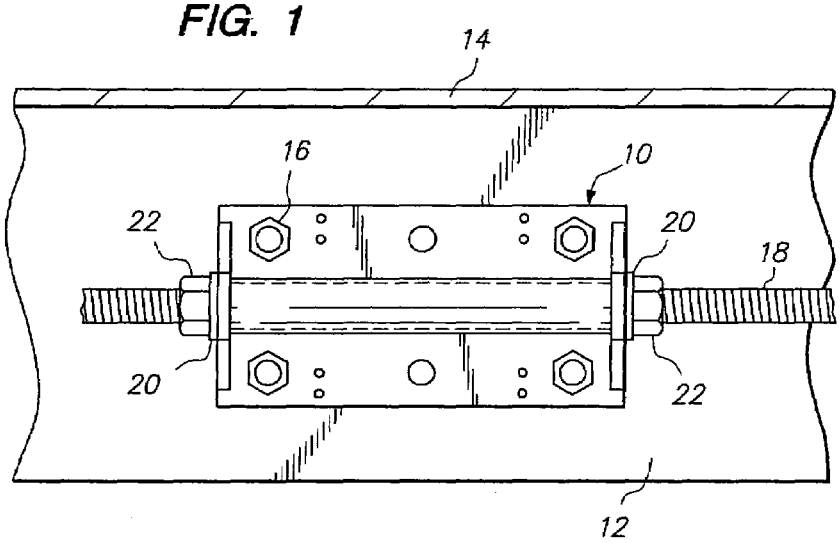
FIG. 1 is an elevation view of a first embodiment of a cross tie bracket attached to a building structural element and showing a rod attached.
Figure 2:
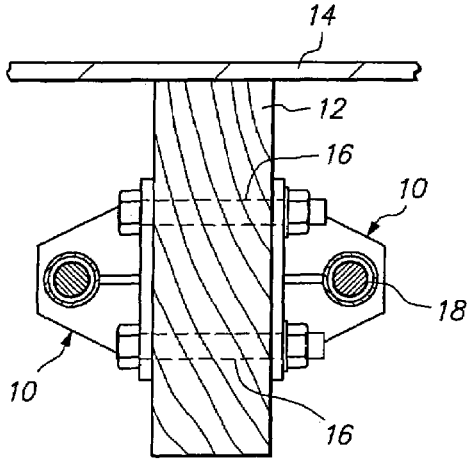
FIG. 2 is a cross-sectional view of two cross tie brackets shown in FIG. 1.

Referring now to the drawings wherein the showings are for purposes of illustrating preferred embodiments of the present invention only, and not for purposes of limiting the same, FIGS. 1 and 2 illustrate a first embodiment of a cross tie bracket 10 fabricated in accordance with the present invention. FIG. 1 shows a single bracket 10 attached to one side of a timber framing element (TFE) 12, while FIG. 2 shows two brackets 10 attached to either side of the TFE 12. The TFE 12 may be part of a wall tie, continuity tie, or collector tie system, and is attached to roof decking or plywood sheathing 14. The bracket 10 is attached to the TFE 12 with threaded fasteners 16 (i.e., bolts and nuts) extending through the TFE 12. As seen in FIG. 2, the fasteners 16 extend through each bracket 10 and into the TFE 12. A threaded rod 18 extends through and is attached to the bracket 10 with thrust or lock washers 20 and nuts 22. The rod 18 is used to span the discontinuities in the continuity tie system. The bracket 10 transfers the loads from the rod 18 into the TFE 12.

Figure 3:
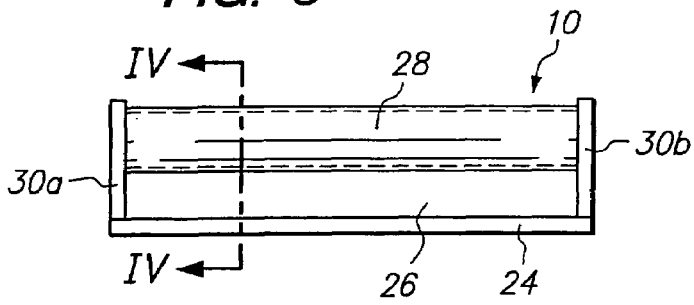
FIG. 3 is a side elevation view of the cross tie bracket shown in FIG. 1.
Figure 4:
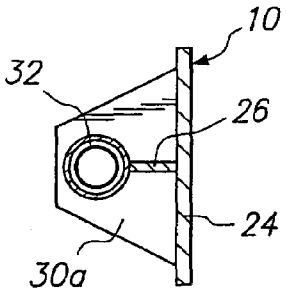
FIG. 4 is a cross-sectional view of the cross tie bracket shown in FIG. 3 taken along line IV-IV.

Referring to FIG. 3, a side elevation view of the continuity bracket 10 of the first embodiment is shown. The bracket 10 has a generally planar base plate 24 formed from a rigid material such as steel. The size, thickness, and material properties of the base plate can vary depending upon the application and, for example, may be formed from ¼ inch ASTM A36 steel. The base plate 24 abuts the TFE 12 when the bracket 10 is installed. Attached to and projecting outwardly from the base plate 24 is a gusset plate 26. As seen in FIG. 4 (a cross-sectional view of the bracket 10 taken along line IV-IV), the gusset plate 26 extends perpendicularly from the base plate 24. The gusset plate 26 is attached to and extends along the longitudinal axis of the base plate 24 through the use of a weld. The size, thickness, and material properties of the gusset plate 26 can vary depending upon the application and, for example, may be formed from ¼ inch ASTM A36 steel.

Attached to the gusset plate 26 is a body 28 extending the longitudinal length of the bracket 10. The body 28 is a generally cylindrical pipe welded to the gusset plate 26. The diameter, thickness, and material properties of the pipe used for the body 28 can vary depending upon the application and, for example, can be formed from 1.25×SCH 40 ASTM A53 Grade B pipe. Typically, the inside diameter of the pipe is predicated on the outside diameter of the rod 18. Typically, the inside diameter of the pipe used for the body 28 is sized to be slightly larger than the outer diameter of the rod 18. In this respect, the rod 18 is slidably insertable into the body 28, but in some situations will still slightly contact the inner wall of the pipe. By using the cylindrical body 28, the strength and load-deformation characteristics of the bracket 10 is the same or increased over the prior art brackets, but the weight of the bracket is reduced.

The bracket 10 of the first embodiment further includes two end bearing plates 30*a* and 30*b*. As seen in FIG. 3, each of the end bearing plates 30 is attached perpendicularly to the base plate 24. Furthermore, each of the end bearing plates 30 are disposed adjacent to respective ends of the gusset plate 26 and the body 28. Each of the end bearing plates 30 is attached or welded to the base plate 24, an end of the body 28, and/or gusset plate 26. The size, thickness, and grade of the end bearing plates 24 can vary depending upon the application and, for example, be formed from ¼ inch ASTM A36 steel.

Formed within each of the end bearing plates 10 is a rod aperture 32 for accepting the rod 18. The rod aperture 32 is positioned at a location on the bearing plate 30 where the interior diameter of the body 28 is aligned with the rod aperture 32 when the end bearing plate 30 is attached to the base plate 24. In this respect, the rod 18 can extend through both of the end bearing plates 30 and into the body 28, as seen in FIG. 1.

Figure 11:
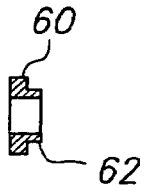
FIG. 11 is a cross-sectional view of a rod aperture insert.
Figure 12:
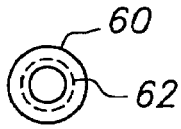
FIG. 12 is a plan view of the rod aperture insert shown in FIG. 11.

Referring to FIG. 11, a rod aperture reducing insert 60 is shown. The insert 60 is used to reduce the diameter of the rod aperture 32 for different sized rods 18. As will be recognized, sometimes it is advantageous to use a smaller diameter sized rod 18 than the size of the rod aperture 32 and inner diameter of the body 28. The insert 60 has a lip 62 which has a diameter that is slightly smaller than the diameter of the rod aperture 32. The lip 62 is insertable into the rod aperture 32. The inner diameter of the insert 60 reduces the diameter of the rod aperture 32 such that rods 18 with reduced diameters can be used with the bracket 10.

Figure 13:
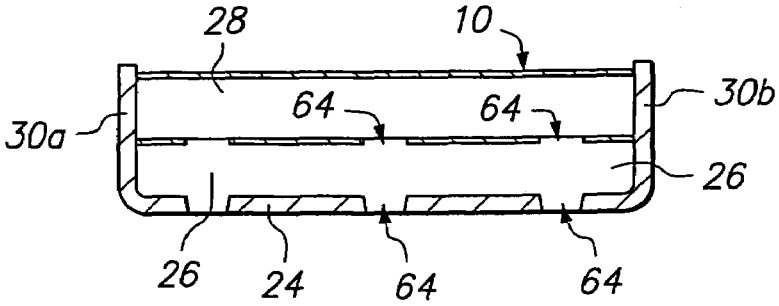
FIG. 13 is a longitudinal cross-sectional view of the cross tie bracket of FIG. 1 formed from interlocking members.

It is also possible to form the bracket 10 by forming the end bearing plates 30 from the base plate 24. Referring to FIG. 13, a cross section of a second variation of the bracket 10 is shown. In this variation of the bracket 10, the base plate 24 and the end bearing plates 30 are all formed from the same section of material. Specifically, the end bearing plates 30 are formed by bending the ends of the base plate 24 upwardly. Also, in the second variation of the bracket 10, cutouts 64 are formed in both the body 28 and the base plate 24 for accepting tabs formed on the gusset plate 26. The tabs and cutouts 64 interlock thereby further securing the body 28 to the base plate 24. The second variation of the bracket 10 is formed by bending the ends of the base plate 24 upwardly while the tabs of the gusset plate 26 are inserted into the cutouts 64.

Figure 5:
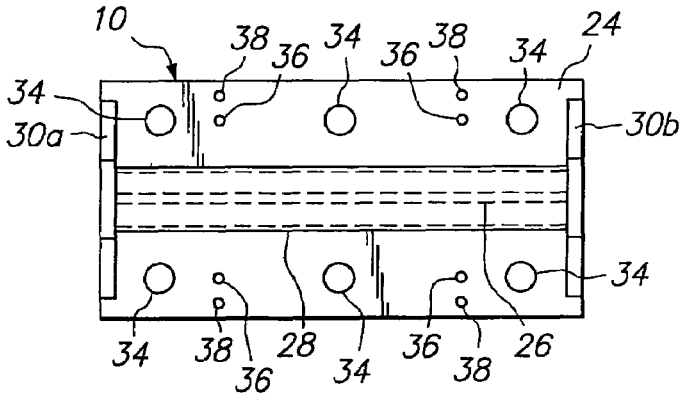
FIG. 5 is a plan view of the cross tie bracket shown in FIG. 1.

Referring to FIG. 5, a top view of the bracket 10 is shown. As previously mentioned, the bracket 10 is attached to the TFE 12 with fasteners 16. The base plate 24 has six bolt apertures 34 through which each fastener 16 is passed through. In this respect, each bolt aperture 34 has a diameter slightly larger than the diameter of the bolt passing there through. Each fastener 16 is tightened up against the base plate 24 in order to secure the bracket 10 to the TFE 12.

Figure 31A:
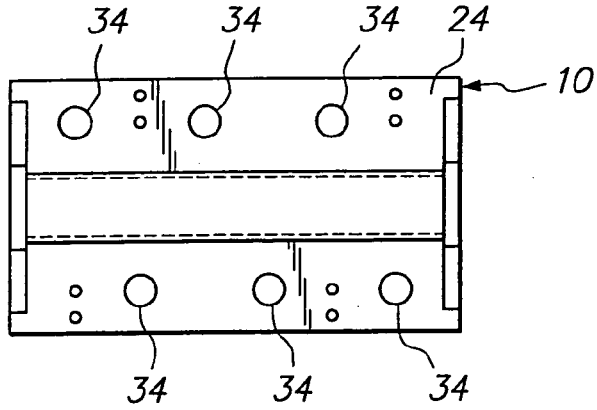
FIGS. 31*a*-31*c* are plan views of alternate configurations for base plates of the cross tie bracket shown in FIG. 5.
Figure 31B:
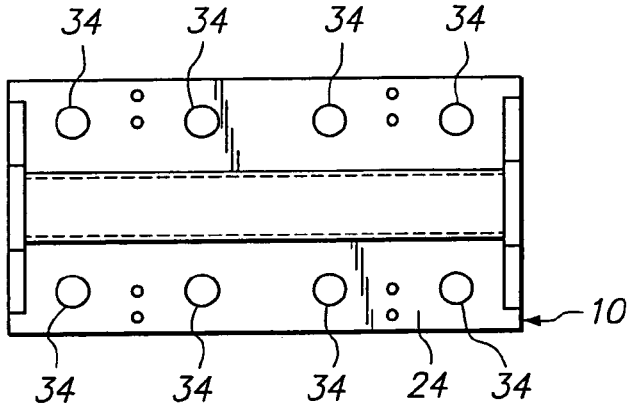
Figure 31C:
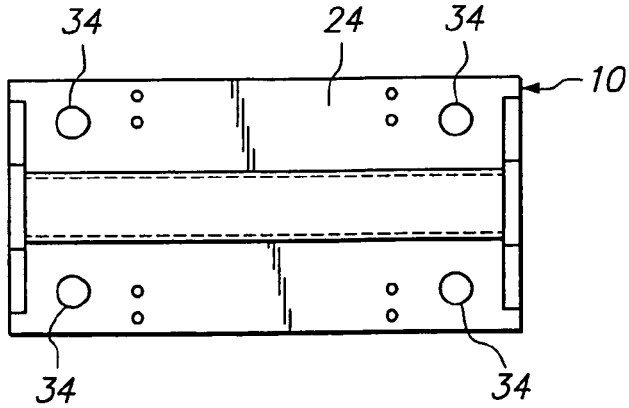

It should be noted that fasteners 16 do not need to be installed in all of the bolt apertures 34 depending upon the application such that one configuration for the base plate 24 will work for more than one application. For wall tie applications only two fasteners 16 will generally be needed (in the two outside diagonally opposing bolt holes). For purlin-to-purlin continuity tie applications only four fasteners 16 will generally be needed. For glulam-to-glulam continuity tie applications six fasteners 16 will generally be needed. Furthermore, the configuration of the apertures 34 shown is illustrative such that other configurations may be contemplated for different applications. For example, the mounting apertures 34 may be staggered (FIG. 31*a*). As seen in FIG. 31*b*, the base plate 24 may contain eight mounting apertures or four mounting apertures (FIG. 31*c*) as needed for the application.

In addition to the foregoing, the base plate 24 further includes four screw apertures 36 used to temporarily secure the bracket to the TFE 12. Specifically, a screw is passed through a respective one of the screw apertures 36 into the TFE 12 in order to secure the bracket 10 to the TFE 12. While secured, then the holes for the other fasteners can be drilled through the bolt apertures 34 into the TFE 12.

Figure 6:
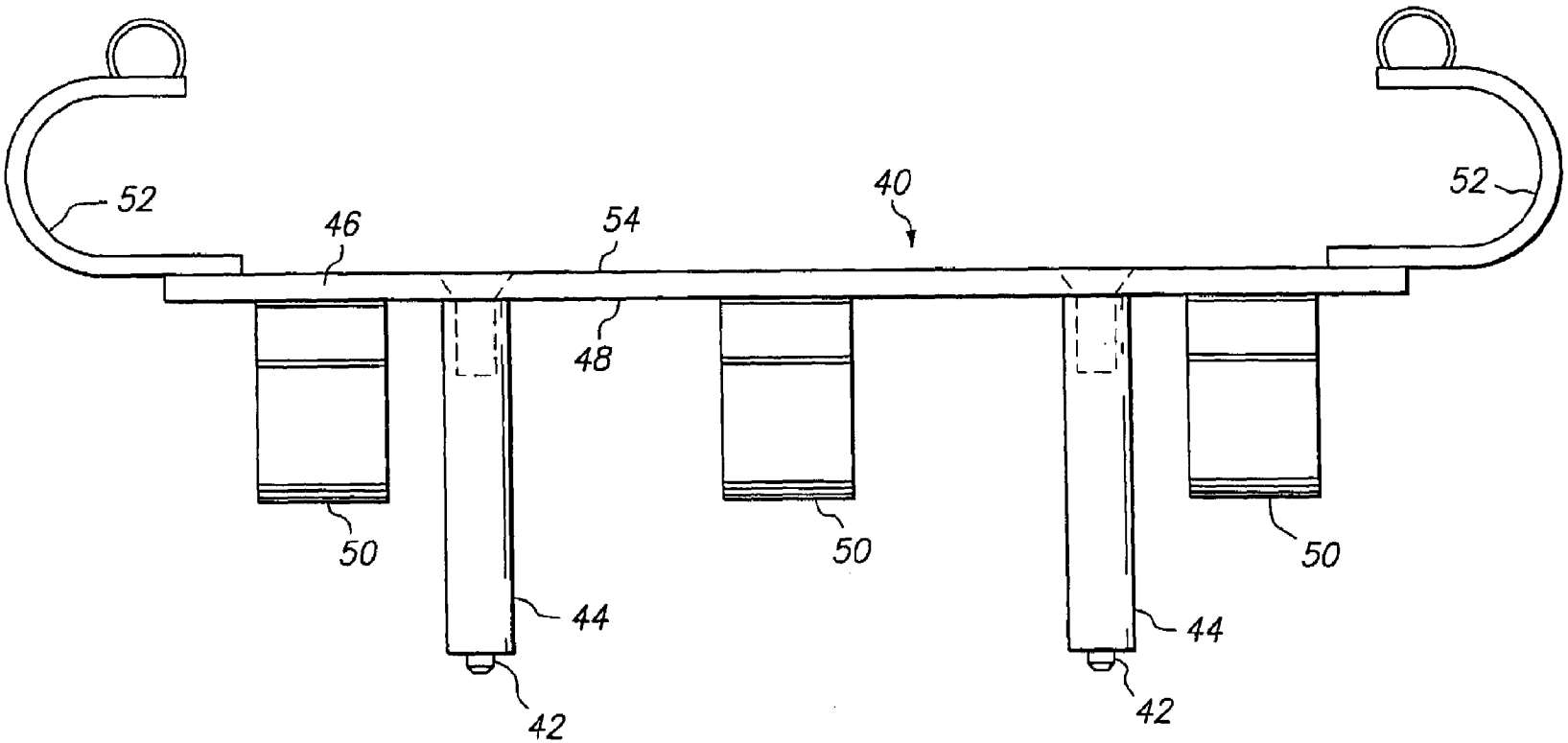
FIG. 6 is a side elevation view of a drill guide for use with the cross tie bracket shown in FIGS. 1-5.

The base plate 24 also has four drill guide alignment pin apertures 38. As will be further explained below, the holes drilled through the TFE 12 for the fasteners 16 need to be aligned in order to attach two brackets 10 to each side of the TFE 12 (see FIG. 2). To facilitate alignment of the holes through the TFE 12, a drill guide 40, as shown in FIG. 6, is used. The drill guide 40 has alignment pins 42 which are insertable into respective ones of the drill guide alignment pin apertures 38, as will be further explained below. Accordingly, the drill guide alignment pin apertures 38 are sized to receive the ends of the alignment pins 42.

The drill guide 40 is used with the bracket 10 to drill holes through the TFE 12 for the fasteners 16. The drill guide 40 is positioned over the top of the base plate 24 and has a drill guide plate 46 from which the alignment pins 42 extend perpendicularly. Each of the alignment pins 42 are generally cylindrical and extend outwardly from a bottom side 48 of the drill guide plate 46. A screw or other type of fastener is used to attach each of the alignment pins 42 to the drill guide plate 46. The alignment pins 42 are positioned on the drill guide plate 46 to precisely align the drill guide 40 over the bracket 10. Each of the alignment pins 42 has a length long enough to position the drill guide plate 46 above the body 28 of the bracket 10 when each alignment pin 42 is inserted into a respective one of the alignment pin apertures 38. Furthermore, each of the alignment pins 42 includes a chamfered end 44 that is insertable into a respective one of the alignment pin apertures 38. The chamfered end 44 facilitates insertion of the alignment pin 42 into the base plate 24. Each of the drill guide alignment pin apertures 38 is sized slightly larger than the outer diameter of the chamfered end 44 so that the end 44 can be insertable therein.

Also attached to the bottom side 48 of the drill guide plate 46 are three spring clips 50 for removably attaching the drill guide 40 to the bracket 10. Each of the spring clips 50 engages the body 28 of the bracket 10. The spring clips 50 removably attach the drill guide 40 to the bracket 10 while the holes for the fasteners 16 are drilled through the TFE 12. The spring clips 50 are attached to the drill guide plate 46 with a fastener such as a screw or rivet. The shape of each of the spring clips 50 is complementary to the shape of the body 28 so that the spring clip 50 engages the body 28 when snapped thereon. Even though only the two outside spring clips 50 are required to secure the drill guide 40 to the bracket 10, a third spring clip 50 is provided, and centered between the outside two spring clips 50. If one of the outside spring clips 50 becomes damaged or broken, the third spring clip 50 can be used as a replacement if needed. It will be recognized that other types of attachment means such as magnets and mechanical locking devices can be used instead of spring clips 50.

The drill guide 40 also includes two handles 52 disposed on opposite ends of the drill guide plate 46. The handles 52 are attached to a top side 54 of the drill guide plate 46 and extend upwardly therefrom. The handles 52 are used to facilitate the attachment of the drill guide 40 to the bracket 10. The handles 52 may be attached to the drill guide plate 46 with fasteners to allow for the temporary removal of one, or both, handles 52 is situations where the drill guide 40 cannot be attached to bracket 10 with either one or both of the handles 52 present. Additionally, the handles 52 are configured in such a manner so as to allow the drill guide 40 to be hung from a ladder rung, or lift railing.

Figure 9:
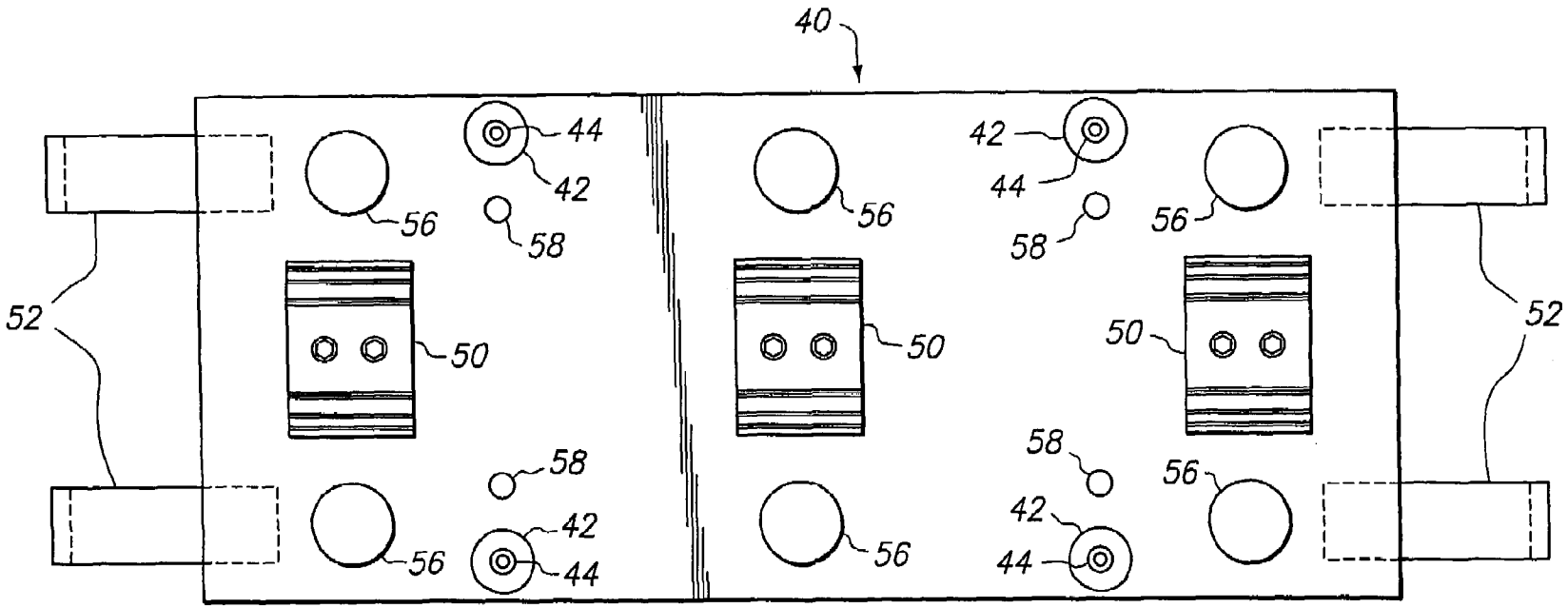
FIG. 9 is a bottom view of the drill guide shown in FIG. 6.
Figure 10:
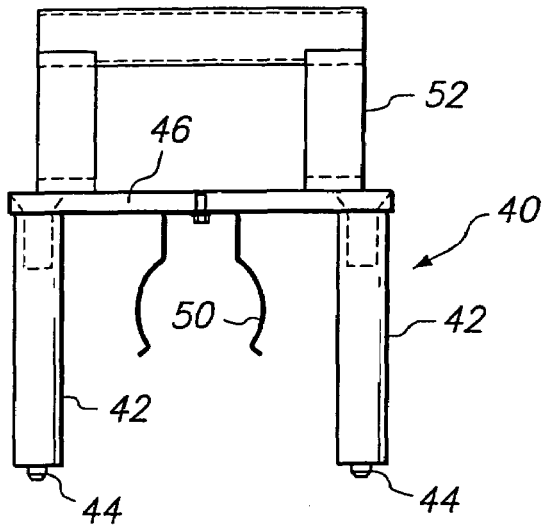
FIG. 10 is an end elevation view of the drill guide shown in FIG. 6.

Referring to FIG. 9, a bottom view of the drill guide plate 46 is shown. The drill guide 46 plate has a series of apertures to allow a drill bit to pass through the plate 46. The apertures are aligned over respective ones of the apertures formed in the bracket 10 when the drill guide 40 is attached. Specifically, the drill guide plate 46 has six drill guide apertures 56 formed therein. Each of the drill guide apertures 56 corresponds to one of the bolt apertures 34 formed in the base plate 24 of the bracket 10. In this respect, each one of the drill guide apertures 56 is aligned over a respective one of the bolt apertures 34 when the drill guide 40 is attached to the bracket 10. The installer can insert an appropriate sized drill bit through the drill guide aperture 56 and the bolt aperture 34 when the drill guide 40 is attached to the bracket 10. The drill guide 40 will align the drill bit perpendicular to the bracket 10 such that the hole formed by the drill bit will be perpendicular to the bracket 10.

Similarly, the drill guide 40 has four drill guide screw apertures 58 formed in the drill guide plate 46. Each of the drill guide screw apertures 58 aligns over a respective one of the screw apertures 36 of the base plate 24. The installer can insert an appropriate sized drill bit through a drill guide screw aperture 58 and the screw aperture 36 of the bracket 10 in order to secure the drill guide 40 to bracket 10, when needed.

It will be recognized that the drill guide plate 46 is similar to the base plate 24. Specifically, the layout of the apertures formed in each plate is identical in order to allow the drill guide plate 46 to align over the base plate 24. Therefore, it is possible to use a base plate 24 as the drill guide plate 46 of the drill guide 40.

Figure 8:
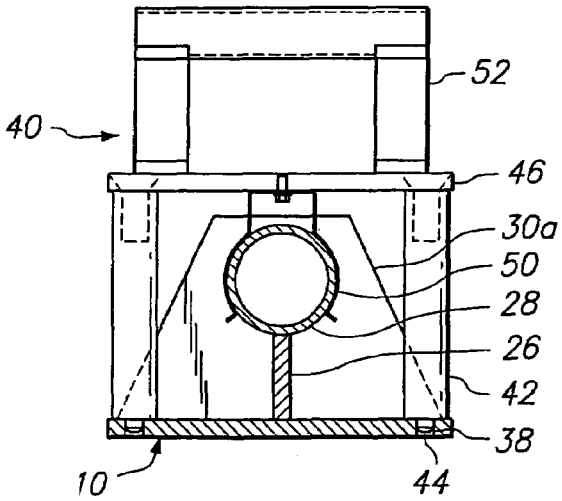
FIG. 8 is a cross-sectional view of the drill guide and cross tie bracket shown in FIG. 7 taken along line VIII-VIII.
Figure 7:
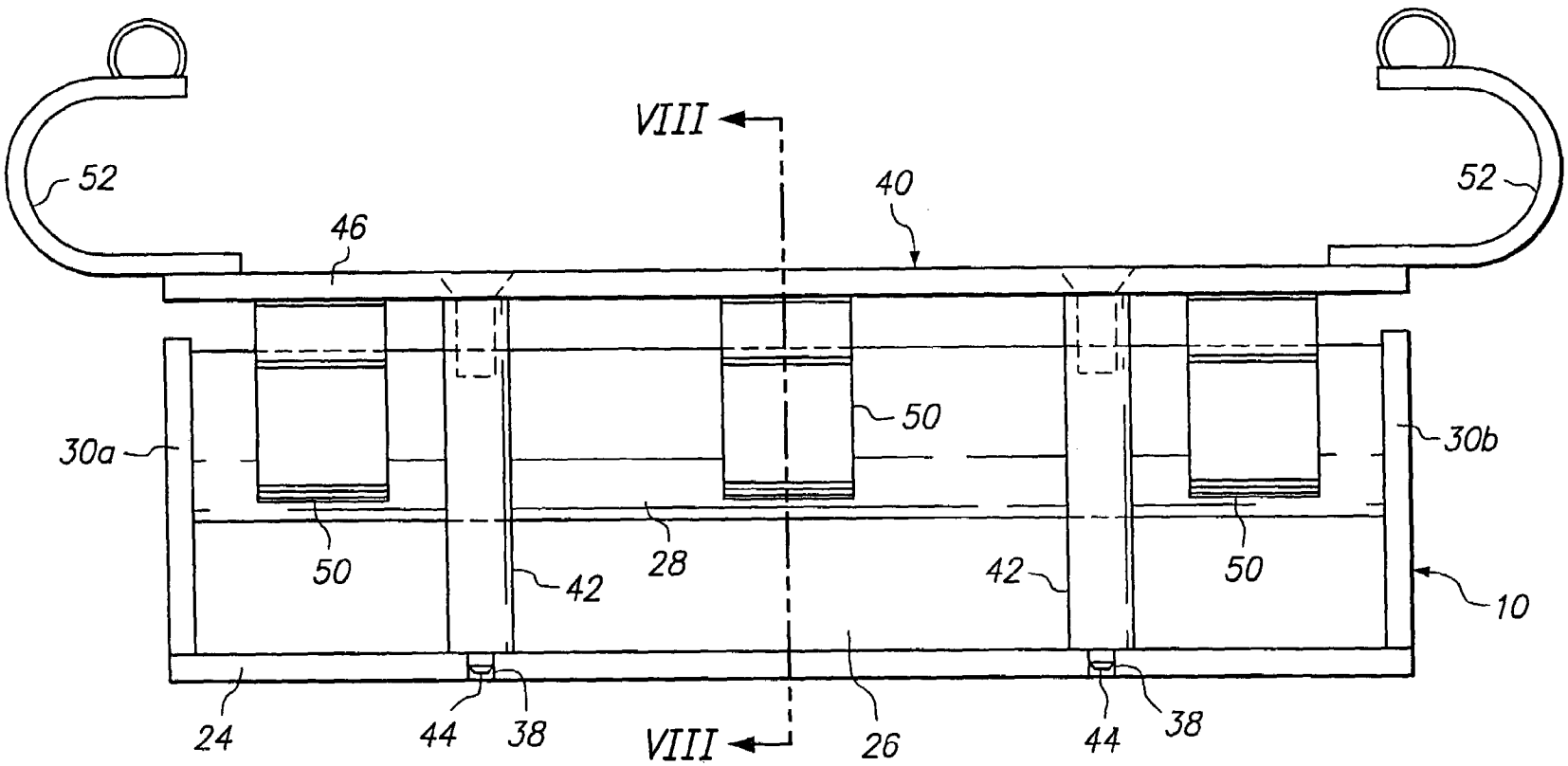
FIG. 7 is a side elevation view of the drill guide shown in FIG. 6 attached to the cross tie bracket shown in FIGS. 1-5.

Referring to FIGS. 7 and 8, the drill guide 40 is shown attached to the bracket 10. As previously discussed, the drill guide 40 snaps onto the body 28 of the bracket 10 with spring clips 50. The spring clips 50 engage the body 28 and maintain the drill guide 40 in precise alignment over the bracket 10. The alignment pins 42 of the drill guide 40 maintain an adequate distance between the drill guide plate 46 of the drill guide 40 and the base plate 24 of the bracket 10. The spring clips 50 maintain tension against the body 28 such that the handles 52 can be used to pick up and hold both the drill guide 40 and bracket 10.

In addition to the foregoing, it is also possible to use a bracket 10 as a drill guide. By attaching alignment pins 42 to the underside of the bracket 10 in the drill guide alignment pin apertures 38, a first bracket 10 can be aligned over a second bracket 10. The second bracket 10 is attached to the TFE 12 with two screws through the screw apertures 36. The first bracket 10 is secured over the first bracket 10 with two screws extending through the remaining screw apertures 36 of both the first and second brackets 10. The alignment pins 42 linearly align the mounting apertures 34 between the first and second brackets 10. In this respect, an installer can insert a drill bit through respective mounting apertures of the first and second brackets 10 to drill the hole in the TFE 12.

Figure 14:
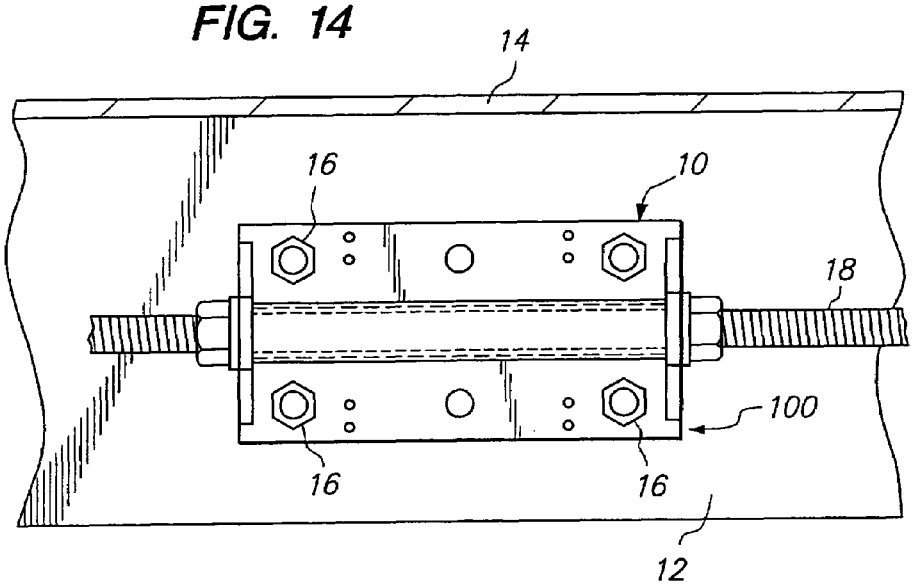
FIG. 14 is an elevation view of a second embodiment of a cross tie bracket attached to a building structural element and showing a rod attached.
Figure 15:
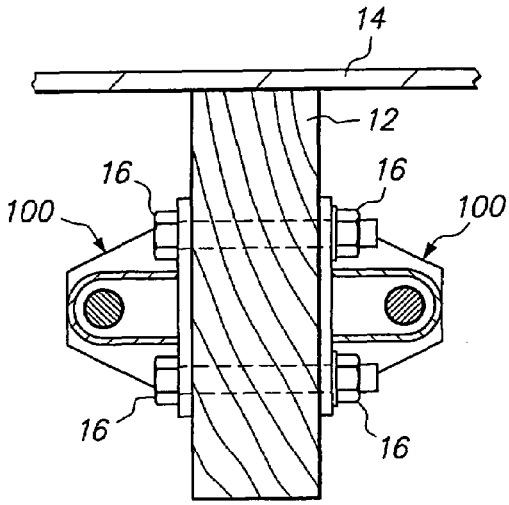
FIG. 15 is an cross-sectional view of two cross tie brackets shown in FIG. 16.
Figure 16:
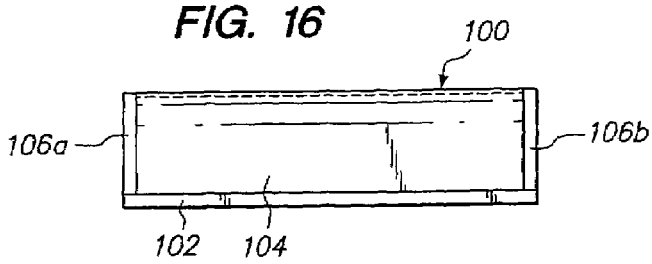
FIG. 16 is a side elevation view of the cross tie bracket shown in FIG. 14.

Referring to FIGS. 14-19, a second embodiment of a cross tie bracket 100 is shown. As seen in FIG. 14, the bracket 100 is attached to a TFE 12 in the same manner as the first embodiment of the bracket 10 and performs the same functions. Namely, the bracket 100 is secured to the TFE 12 with fasteners 16 and accepts rod 18 which is secured to the bracket 100 with nut 22 and thrust or lock washer 20. As seen in FIG. 15, two brackets 100 can be mounted opposite one another on a TFE 12.

Figure 17:
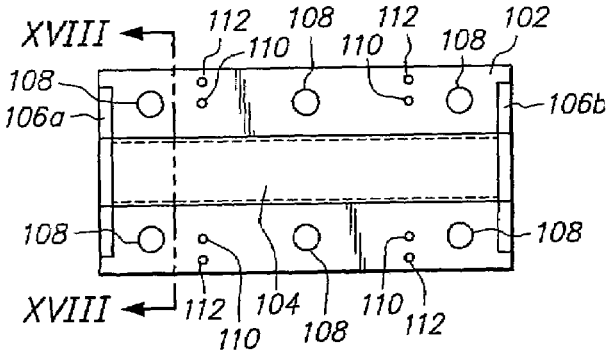
FIG. 17 is a plan view of the cross tie bracket shown in FIG. 14.

A plan view of the second embodiment of the cross tie bracket 100 is shown in FIG. 17. The bracket 100 has a base plate 102 that is similar to the base plate 24 of the first embodiment of the bracket 10. Specifically, the base plate 102 has six bolt apertures 108 formed therein for attaching the bracket 100 to the TFE 12. Furthermore, the base plate 102 has four screw apertures 110 for temporary attachment of the bracket 100 to the TFE 12, as well as four drill guide alignment pin apertures 112 for aligning the drill guide 40. In this respect, it is possible to use the base plate 24 of the bracket 10 as the base plate 102 of the second embodiment of the cross tie bracket 100.

Figure 18:
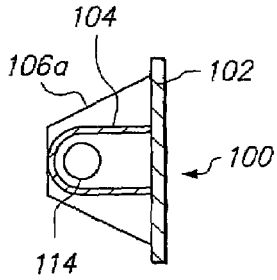
FIG. 18 is a cross-sectional view of the cross tie bracket shown in FIG. 17 taken along line XVIII-XVIII.

The bracket 100 also has a U-shaped body 104. The body 104 is welded or otherwise attached to the base plate 102. The U-shaped body 104 is formed by bending a generally planar section of material (such as steel) into a generally U-shaped configuration. A cross section of the body 104 is shown in FIG. 18. The legs of the U-shaped body 104 are attached or otherwise welded to the base plate 102. The size, thickness, and material properties of the U-shaped body 104 can vary depending upon the application.

Attached to each one of the ends of the body 104, as well as to the base plate 102, are respective end bearing plates **106*a* and 106*b*. Each of the end bearing plates 106 is securely attached or welded to the base plate 102, as well as to the ends of the body 104. Each of the end bearing plates 106 also has a rod aperture 114 formed therein for accepting the rod 18. The diameter of the rod aperture 114 is slightly larger than the diameter of the rod 18 such that the rod 18 can be slid through both rod apertures 114 and into the body 104. Also, the rod aperture reducing insert 60 can be inserted into the rod aperture 114** in order to reduce the diameter thereof.

The drill guide 40 can be used with the bracket 100 with some simple modifications. Specifically, the spring clips 50 of the drill guide 40 must be modified to frictionally engage the U-shaped body 104. Accordingly, the spring clips 50 will have a shape that is complementary to the shape of the body 104 for engagement purposes.

Figure 19:
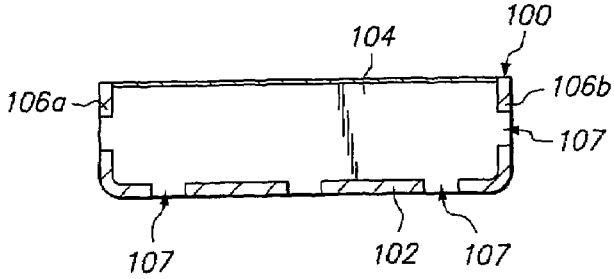
FIG. 19 is a longitudinal cross-sectional view of the cross tie bracket of FIG. 14 formed from interlocking members.

Referring to FIG. 19, a cross sectional view of a second variation of the bracket 100 is shown. In this variation, the bracket 100 is formed by bending the ends of the base plate 102 upwardly to form the end bearing plates 106. Furthermore, the base plate 102 has cutouts 107 formed therein for receiving tabs formed in the body 104. The tabs of the body 104 interlock with the cutouts 107 of the base plate 102 in order to securely connect the body 104 thereto. The second variation of the bracket 100 is formed by bending the ends of the body 104 upwardly to form the end bearing plates 106 while the body 104 is in place. The tabs and cutouts 107 interlock the body 104 and the base plate 102 together.

Figure 20:
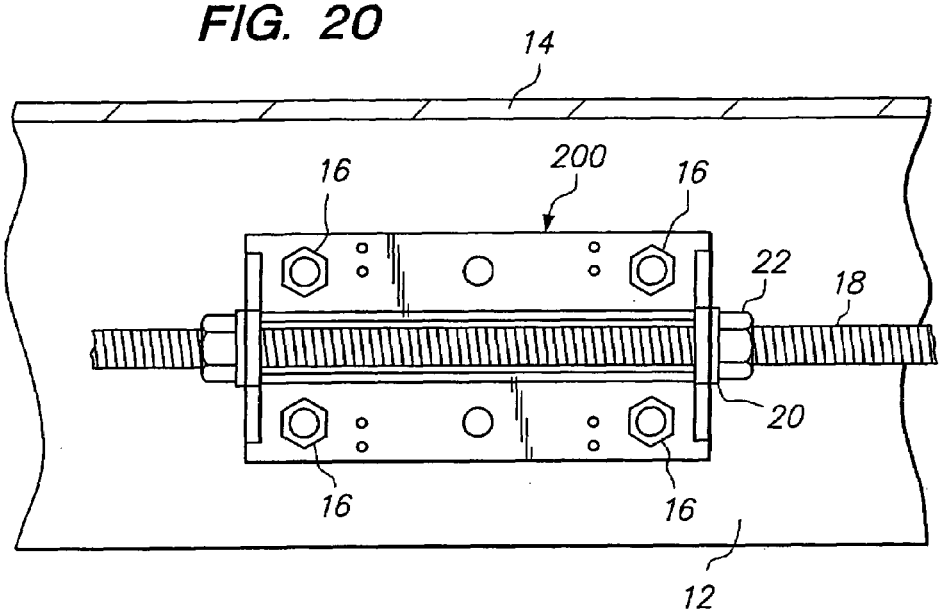
FIG. 20 is an elevation view of a third embodiment of a cross tie bracket attached to a building structural element and showing a rod attached.
Figure 21:
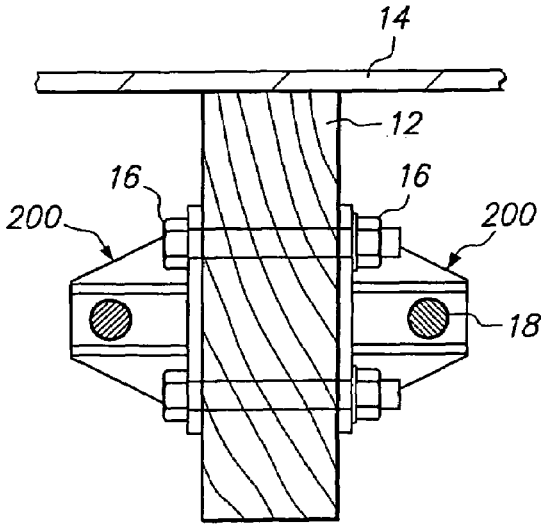
FIG. 21 is an cross-sectional view of two cross tie brackets shown in FIG. 20.
Figure 22:
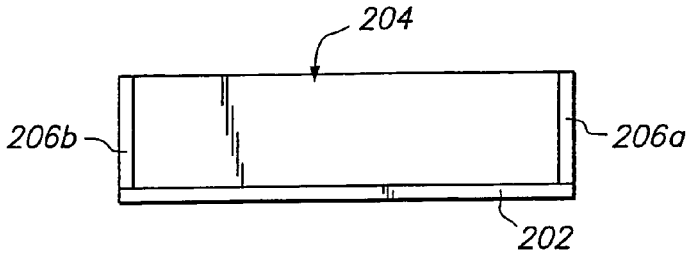
FIG. 22 is a side elevation view of the cross tie bracket shown in FIG. 20.

Referring to FIGS. 20-25, a third embodiment of a cross tie bracket 200 is shown. The bracket 200 is attached to the TFE 12 in the same manner as the first and second embodiments of the bracket 10 and 100. The bracket 200 performs the same functions as the first and second embodiments 10 and 100 by providing a bracket for attaching a rod 18. The bracket 200 is secured to the TFE 12 with fasteners 16. As seen in FIG. 21, two brackets 200 can be mounted on opposite sides of the TFE 12.

Figure 23:
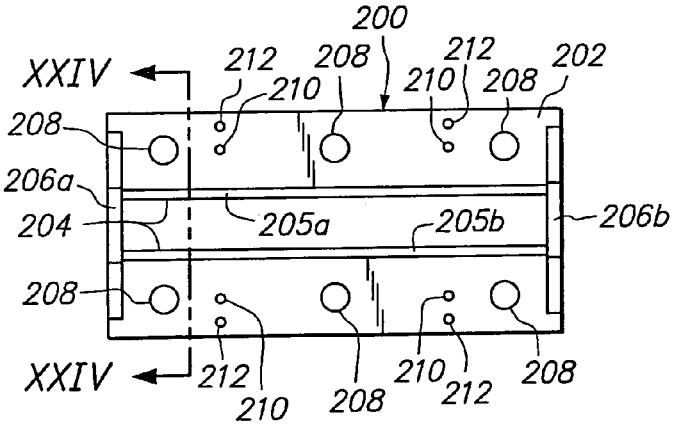
FIG. 23 is a plan view of the cross tie bracket shown in FIG. 20.
Figure 24:
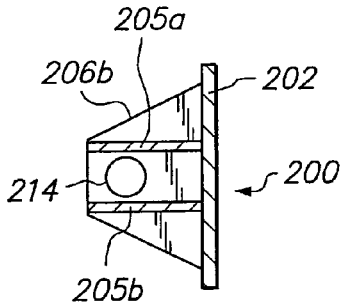
FIG. 24 is a cross-sectional view of the cross tie bracket shown in FIG. 23 taken along line XXIV-XXIV.

A plan view of the third embodiment of the cross tie bracket 200 is shown in FIG. 23. The bracket 200 has a base plate 202 that is similar to the base plate 24 of the first embodiment of the bracket 10. Specifically, the base plate 202 has six bolt apertures 208 formed therein for attaching the bracket 200 to the TFE 12. Furthermore, the base plate 202 has four screw apertures 210 for temporary attachment of the bracket 200 to the TFE 12 with screws. Furthermore, the base plate 202 of the bracket 200 has four drill guide alignment pin apertures 212 for aligning the drill guide 40. Accordingly, it is possible to use the base plate 24 of the bracket 10 as the base plate 202 for the third embodiment of the cross tie bracket 200.

The bracket 200 has a body 204 formed from two generally planar sections **205*a*, 205*b* of material (such as steel) which span the length of the base plate 202. Each of the sections 205 is welded or otherwise attached perpendicularly to the base plate 202. Each of the sections 205 is placed on the base plate 202 so as to be on either side of the rod 18, as seen in FIG. 20. Accordingly, the sections 205 of the body 204 define a channel of the bracket 200 for the rod 18. The size, thickness, and material properties of the two generally planar sections 205***a*, 205*b* can vary depending upon the application.

Attached to each of the ends of the body 204 (i.e., sections 205) are respective end bearing plates 206*a*, 206*b*. Each of the end bearing plates 206 is securely attached or welded to the base plate 202, as well as to the ends of the body 204. Each of the end bearing plates 206 also has a rod aperture 214 formed therein for accepting the rod 18. The diameter of each of the rod apertures 214 is slightly larger than the diameter of the rod 18 such that the rod 18 can slide through both rod apertures 214 and into the channel defined by the body 204. It will be recognized by those of ordinary skill in the art that the rod aperture reducing insert 60 can be inserted into each of the rod apertures 214 of the end bearing plates 206 in order to reduce the diameter of the rod apertures 214.

Figure 25:
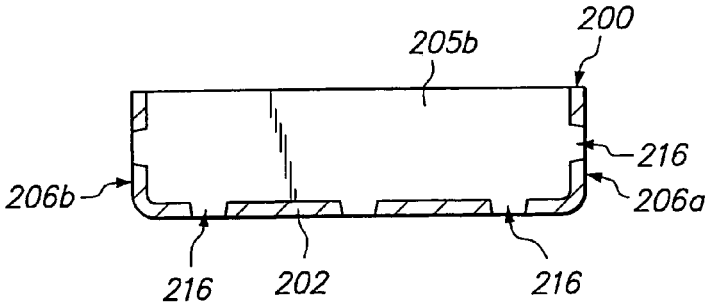
FIG. 25 is a longitudinal cross-sectional view of the cross tie bracket of FIG. 20 formed from interlocking members.
Figure 26:
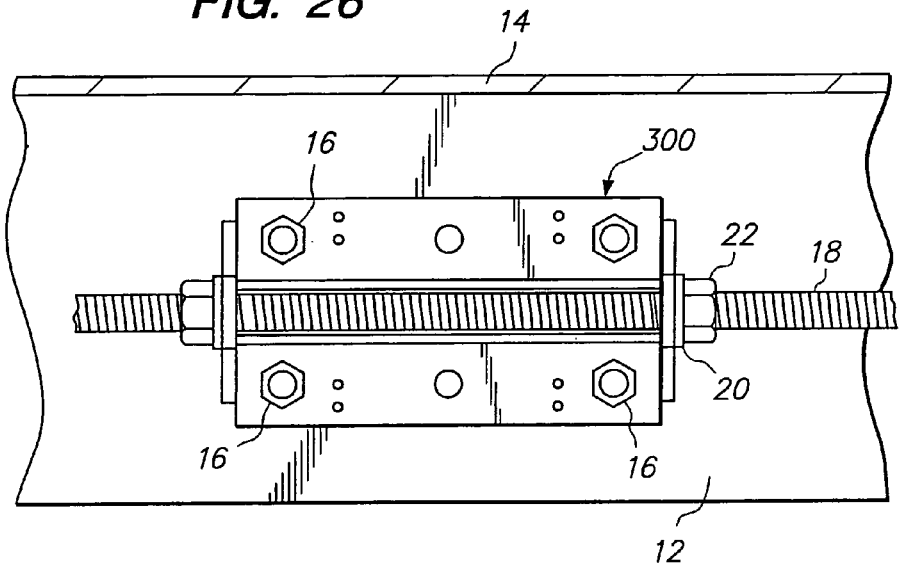
FIG. 26 is an elevation view of a fourth embodiment of a cross tie bracket and attached to a building structural element and having a rod attached.

Referring to FIG. 25, a cross-section view of a second variation of the bracket 200 is shown. In this variation, the bracket 200 is formed by bending up the ends of the base plate 202 to form the end bearing plates 206. Furthermore, the base plate 202 is formed with cutouts 216 for receiving tabs formed in each section of the body 204. Specifically, each section 205 of the body 204 is formed with tabs that are inserted into corresponding cutouts of the base plate 204. The second variation of the bracket 200 is formed by bending the ends of the base plate 204 while the sections 205 of the body 204 are in place.

Figure 27:
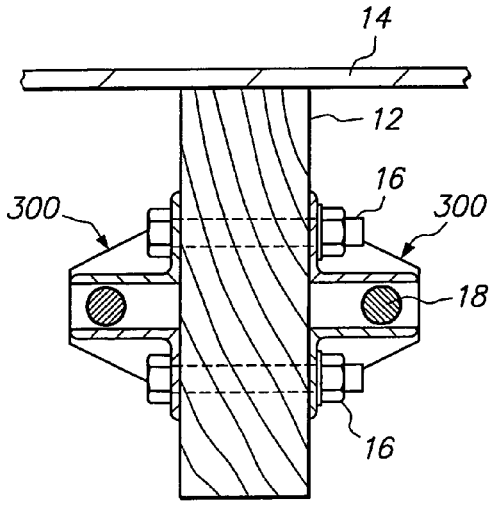
FIG. 27 is an cross-sectional view of two cross tie brackets shown in FIG. 26.

A fourth embodiment of a cross tie bracket 300 is illustrated in FIGS. 26-30. The bracket 300 is attached to the TFE 12 ins the same manner as the first, second and third embodiments. The bracket 300 also performs the same function as the brackets 10, 100 and 200. As seen in FIG. 27, two brackets 300 can be attached to opposite sides of the TFE 12.

Figure 28:
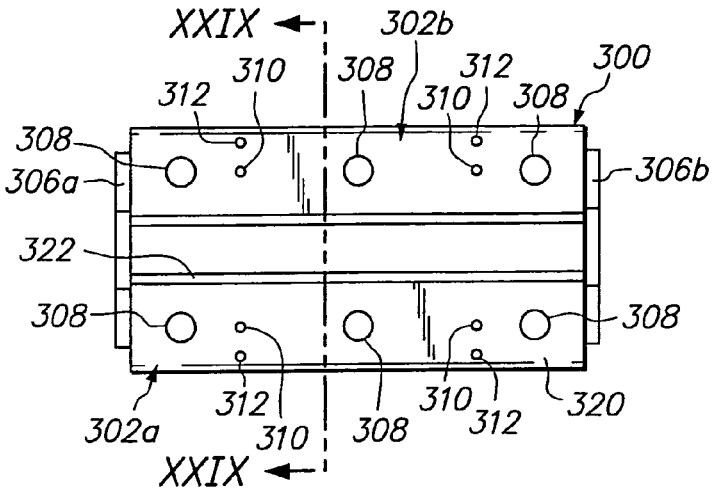
FIG. 28 is an plan view of the cross tie bracket shown in FIG. 26.
Figure 29:
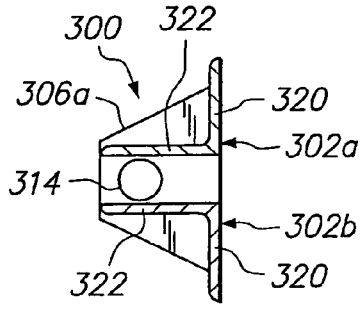
FIG. 29 is a cross-sectional view of the cross tie bracket shown in FIG. 28 taken along line XXIX-XXIX.
Figure 30:
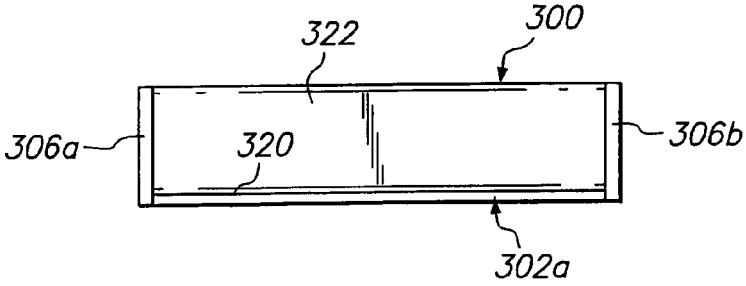
FIG. 30 is a side elevation view of the cross tie bracket shown in FIG. 26.

A top view of the bracket 300 is shown in FIG. 28. The bracket 300 has two angle elements 302*a* and 302*b*. Each of the angle elements 302 has three bolt apertures 308 formed therein for attaching the bracket 300 to the TFE 12 with the appropriate fasteners. Furthermore, each of the angle elements 302 has two drill guide alignment pin apertures 312 for aligning the drill guide 40 and two screw apertures 310 for temporary attachment of the bracket 300 to the TFE 12 with screws. Accordingly, because the bracket has two angle elements 302 (i.e., 302*a* and 302*b*), there are a total of six bolt apertures 308, four screw apertures 310, and four drill guide alignment pin apertures 312. Each angle element 302 is generally L-shaped and has the bolt apertures 308, screw apertures 310 and alignment pin apertures 312 formed in a base portion 320 thereof. Disposed generally perpendicular to the base portion 320 of each angle element 302 is an angle portion 322.

The bracket 300 also has two end bearing plates 306*a* and 306*b* attached to the ends of the angle elements 302. Each bearing plate 306 is attached or otherwise welded to the same ends of the angle elements 302. Formed in each bearing plate 306 is a rod aperture 314 sized to accept the rod 18. The angle elements 302 are welded to the bearing plates 306 on either side of the rod aperture 314. In this respect, the angle portions 322 of the angle elements 302 define a channel within which the rod 18 is disposed. A rod aperture reducing insert 60 can be placed within the rod aperture 314 in order to reduce the diameter of the rod aperture 314, as previously described.

Additional modifications and improvements of the present invention may also be apparent to those of ordinary skill in the art such as using a different type of material for the brackets. Thus, the particular combination of parts described and illustrated herein is intended to represent only certain embodiments of the present invention, and is not intended to serve as limitations of alternative devices within the spirit and scope of the invention.

What is claimed is:

1. A separable combination of a drill guide and a cross tie bracket, comprising:

a cross tie bracket including a base means attachable to a building structural element, at least one mounting aperture, and at least one pin aperture;

a drill guide including:

a generally planar alignment plate;

at least one alignment pin attached generally perpendicular to the alignment plate and having a tip inserted into the pin aperture; and at least one mounting alignment aperture formed in the alignment plate;

wherein the drill guide is placed on the cross tie bracket so that the alignment pin linearly aligns the mounting alignment aperture with the mounting aperture; and wherein the alignment pin is sized to position the alignment plate in a spaced-apart relationship with the base means.

2. The separable combination of claim 1 further comprising an attachment bracket attached to the alignment plate for securing the drill guide to the bracket.

3. The separable combination of claim 1 further comprising attachment means for securing the drill guide to the cross tie bracket.

4. The separable combination of claim 3 wherein the attachment means are one of screws, nails or fasteners.

5. The separable combination of claim 3 wherein the attachment means are a spring clip.

6. The separable combination of claim 3 wherein the attachment means are a magnet.

7. The separable combination of claim 1 wherein the tip of the alignment pin is rounded to facilitate insertion into the pin aperture.

8. The separable combination of claim 1 wherein the number of mounting alignment apertures is at least equal to the number of mounting apertures formed in the cross tie bracket.

9. A separable combination of a drill guide and a cross tie bracket, comprising:

a cross tie bracket including a base means attachable to a building structural element, at least one mounting aperture, and at least one pin aperture;

a drill guide including:

a generally planar alignment plate;

at least one alignment pin attached generally perpendicular to the alignment plate and having a tip inserted into the pin aperture; and at least one mounting alignment aperture formed in the alignment plate;

wherein the drill guide is placed on the cross tie bracket so that the alignment pin linearly aligns the mounting alignment aperture with the mounting aperture; and at least one screw alignment aperture formed in the alignment plate, the screw alignment aperture being linearly aligned with a screw aperture of the cross tie bracket.

10. The separable combination of claim 9 further comprising an attachment bracket attached to the alignment plate for securing the drill guide to the bracket.

11. The separable combination of claim 9 further comprising attachment means for securing the drill guide to the cross tie bracket.

12. The separable combination of claim 9 wherein the tip of the alignment pin is rounded to facilitate insertion into the pin aperture.

13. A separable combination of a drill guide and a cross tie bracket, comprising:

a cross tie bracket including a base means attachable to a building structural element, at least one mounting aperture, and at least one pin aperture;

a drill guide including:

a generally planar alignment plate;

at least one alignment pin attached generally perpendicular to the alignment plate and having a tip inserted into the pin aperture; and at least one mounting alignment aperture formed in the alignment plate;

wherein the drill guide is placed on the cross tie bracket so that the alignment pin linearly aligns the mounting alignment aperture with the mounting aperture; and at least one handle attached to the alignment plate for positioning the drill guide on the cross tie bracket.

14. The separable combination of claim 13 wherein the handle is configured to hang the drill guide.

15. The separable combination of claim 13 further comprising an attachment bracket attached to the alignment plate for securing the drill guide to the bracket.

16. The separable combination of claim 13 further comprising attachment means for securing the drill guide to the cross tie bracket.

17. The separable combination of claim 13 wherein the tip of the alignment pin is rounded to facilitate insertion into the pin aperture.

* * * * *